US005980600A

United States Patent [19]

Stopyra et al.

[11] Patent Number: 5,980,600

[45] Date of Patent: Nov. 9, 1999

[54] FILTER MOUNTING FRAME

[75] Inventors: Stephen Stopyra; Richard J. Duell, both of Syracuse; Theodore S. Bolton, Liverpool, all of N.Y.

[73] Assignee: Carrier Corporation, Farmington, Conn.

[21] Appl. No.: 09/017,355

[22] Filed: Feb. 2, 1998

[51] Int. Cl.[6] ..... B01D 29/07

[52] U.S. Cl. ..... 55/471; 55/497; 55/502; 55/506; 55/507; 55/511; 55/DIG. 31; 96/423

[58] Field of Search ..... 55/506, 511, 481, 55/502, 497, 500, 501, DIG. 31, 480, 490, 495, 467, 471, 507; 96/423

[56] References Cited

U.S. PATENT DOCUMENTS 4,001,912 1/1977 Eriksson ..... 15/339
4,773,922 9/1988 Ross et al. ..... 55/481
5,378,254 1/1995 Maly et al. ..... 96/423
5,674,303 10/1997 Ter Horst ..... 55/497

FOREIGN PATENT DOCUMENTS 4-193318 7/1992 Japan ..... 55/467

*Primary Examiner*—Jay H. Woo
*Assistant Examiner*—Robert A. Hopkins
*Attorney, Agent, or Firm*—Wall Marjama Bilinski & Burr

[57] ABSTRACT

A filter assembly for use in an air purifier unit having a rectangular shaped air inlet entrance to the unit blower. A rectangular shaped frame containing a HEPA filter pack is slidably received within the blower inlet. An L-shaped flange surrounds the filter frame and closes against the air inlet of the blower to provide an air seal. The top wall of the flange is offset some distance from an adjacent wall of the frame to provide a handle for the filter assembly.

6 Claims, 6 Drawing Sheets

FILTER MOUNTING FRAME

BACKGROUND OF THE INVENTION

This invention relates to an air purifier unit and, in particular, to a high efficiency filter assembly for use in a portable air purifying unit.

As the air we breathe becomes more contaminated, the need for better, higher efficiency air purification equipment becomes more pronounced, particularly in the more densely populated areas. Much of the air pollution in these populated regions is caused by automobile exhaust emissions and industrial plants that burn fossil fuel in order to satisfy their power demands. This type of pollution is difficult to cleanse from the air and cannot be effectively handled by conventional filter found in furnace and air conditioning systems. As a consequence, people who suffer from respiratory ailments are oftentimes forced to remain indoors when the air quality drops below a certain safe value. Ideally, while indoors, these people should breathe air that has been circulated through a high efficiency air purifying system. This type of system is typically costly and not easily transported from place to place. Inexpensive portable units are available, however, the dependability and operability of these units is sometimes less than satisfactory.

A new high efficiency particle arrestor (HEPA) filter pack has been developed which is suitable for use in portable air handling units and, in particular, in an air purification system. The filter material is contained in a rectangular shaped package. The package, however, has relatively little structural strength and poses certain difficulties relating to securing it within a unit and in handling the package during installation and removal from a unit so that the filter is not damaged.

SUMMARY OF THE INVENTION

It is therefore an object of the present invention to improve air handling equipment and, in particular, air purification units.

A further object of the present invention is to provide a frame for a HEPA filter pack that protects the pack and which is easily handled during installation and removal from an air purification unit.

Yet a still further object of the invention is to provide a filter assembly containing a HEPA filter pack that is capable of providing a positive air seal with an air inlet of a blower system employed in an air purification system.

Another object of the present invention is to minimize the amount of air bypassing the filter installed in an air handling unit.

Yet another object of the present invention is to provide a filter assembly for installation in a portable air purifier that has a built-in safety feature for inactivating the blower motor of the system when the filter is misaligned or removed from the system.

These and other objects of the present invention are attained by a filter assembly for installation in an air purification unit that has a rectangular air inlet to the system blower. The filter assembly includes a rectangular frame for housing a HEPA filter pack. An L-shaped flange surrounds the frame and opens toward the front of the frame. The flange is adapted to receive the front edge of the blower inlet therein. The front edge of the air inlet closes against the back wall of the flange to prevent air drawn into the assembly by the blower from leaking by the flange. The flange is extended outwardly above the top wall of the filter frame to provide a handle for carrying the filter assembly and facilitating installation and removal of the assembly from the unit.

DESCRIPTION OF THE INVENTION

Figure 1:
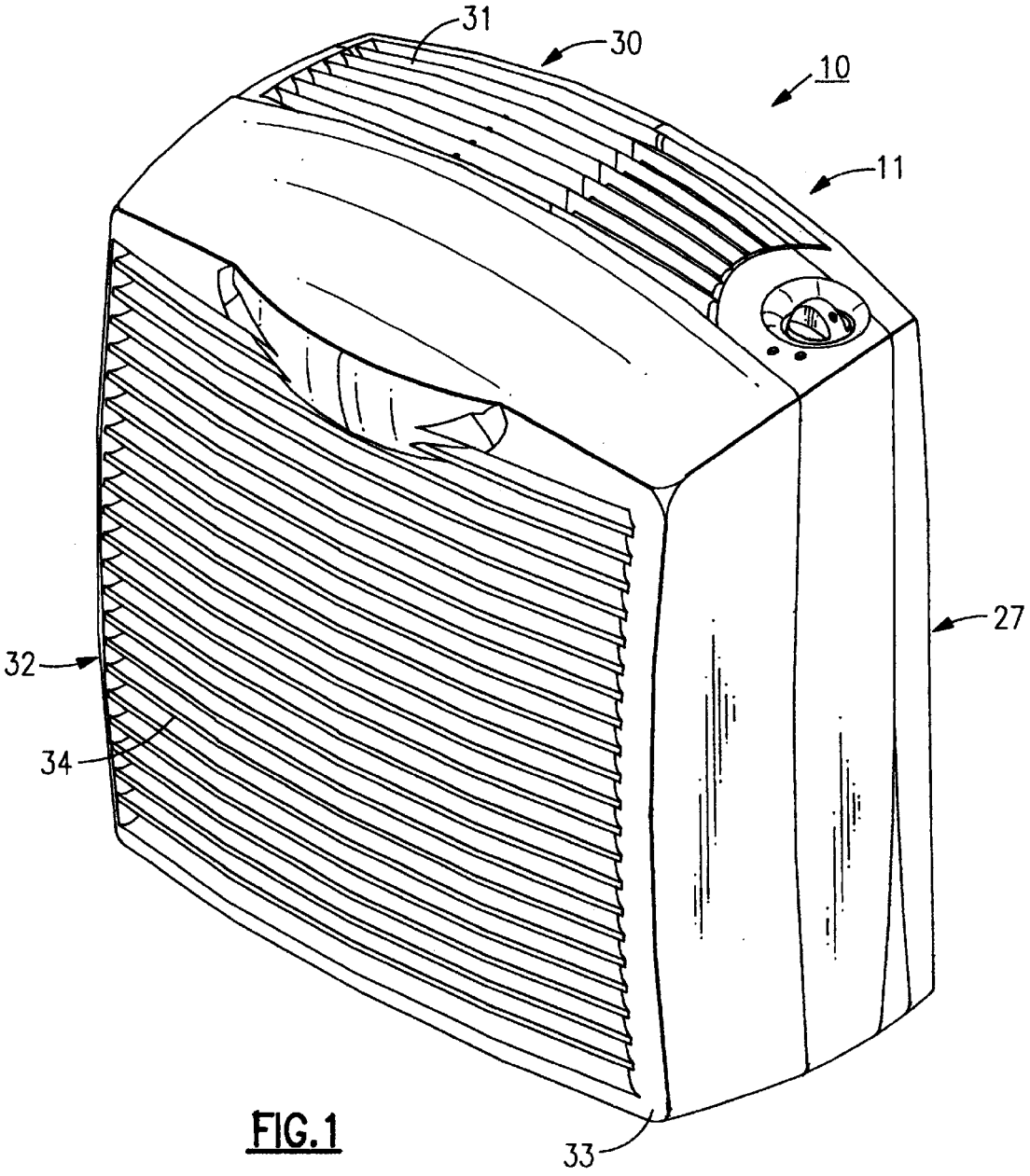
FIG. 1 is a perspective view showing an air purification unit embodying the teachings of the invention.
Figure 2:
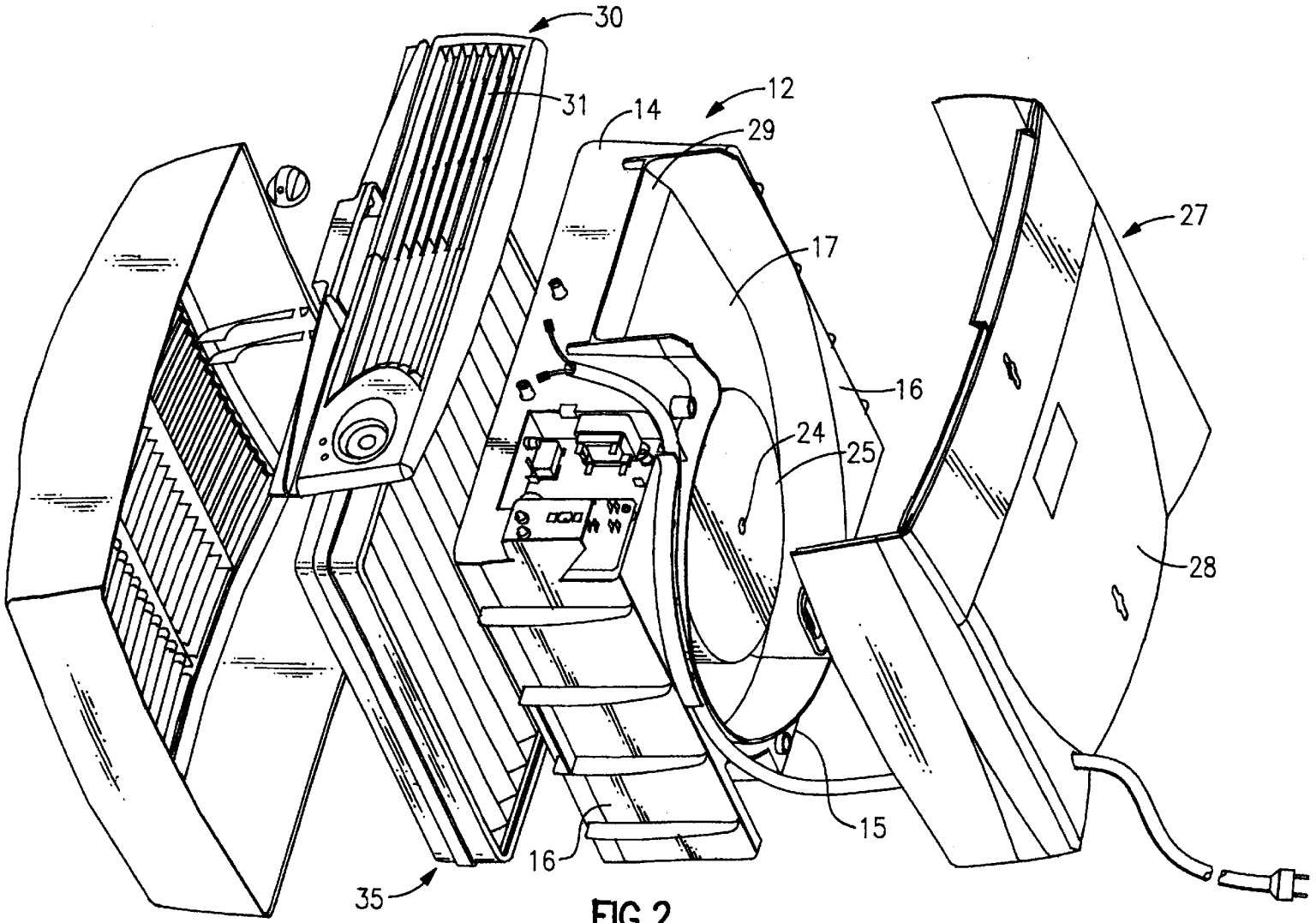
FIG. 2 is an exploded view, in perspective, showing the component parts of the unit.
Figure 3:
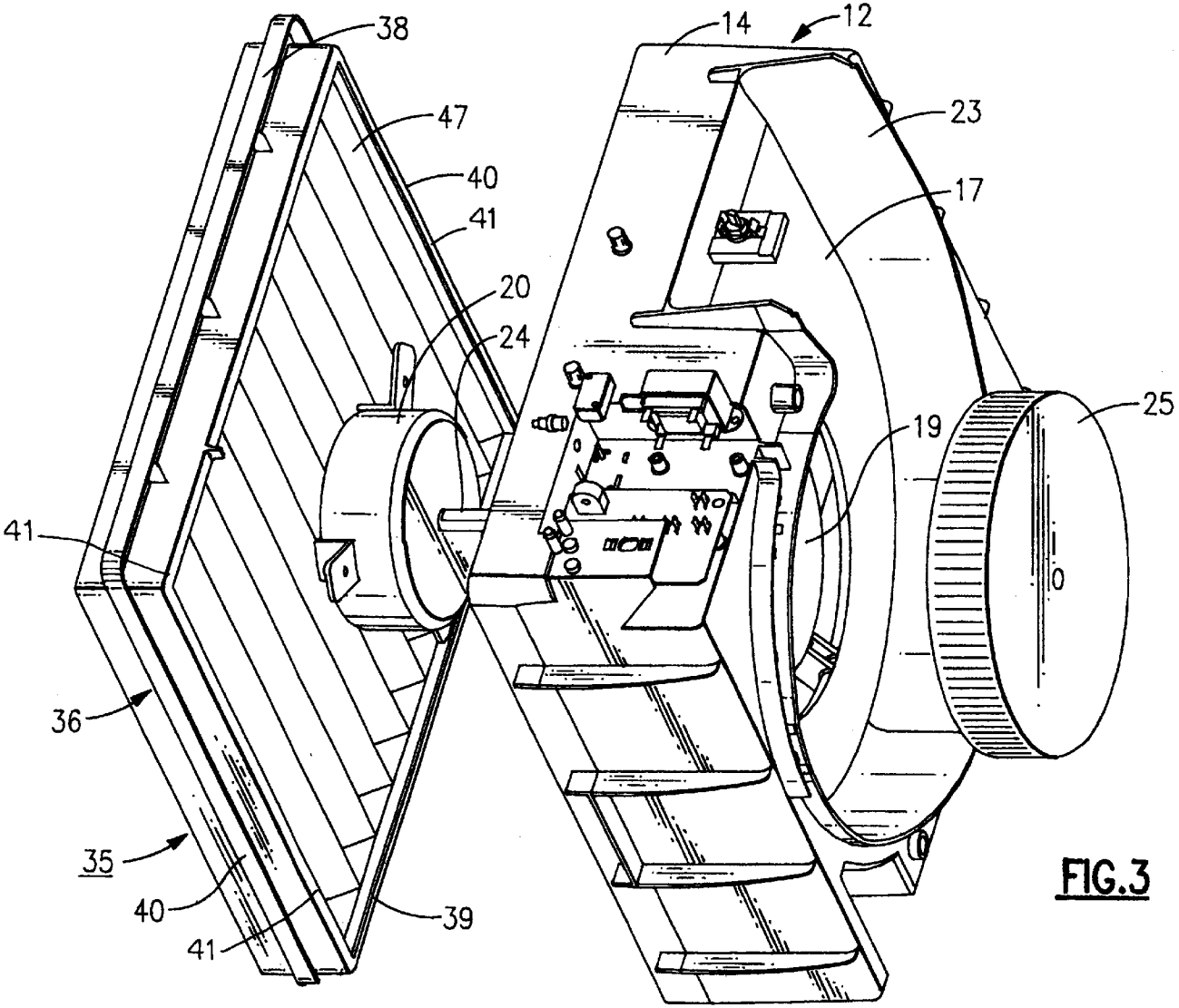
FIG. 3 is an enlarged explode view in perspective the filter assembly of the present invention and the main support frame of the unit.
Figure 6:
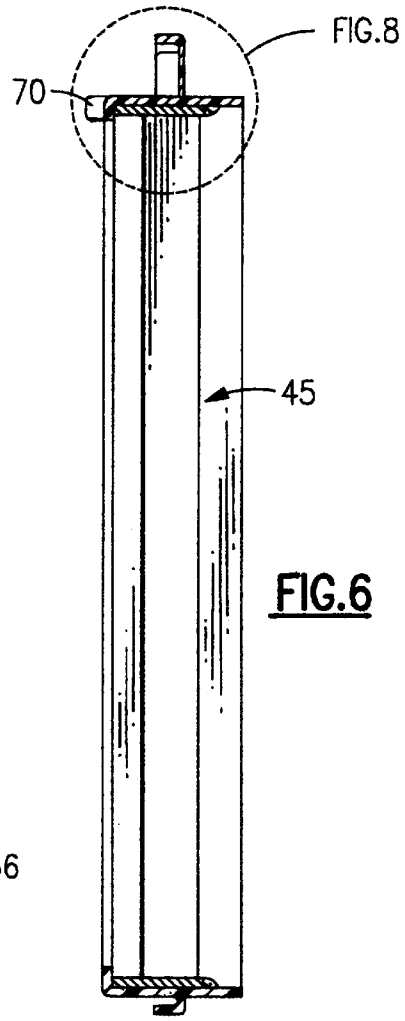
FIG. 6 is a sectional view taken along lines 6—6 in FIG. 4.
Figure 4:
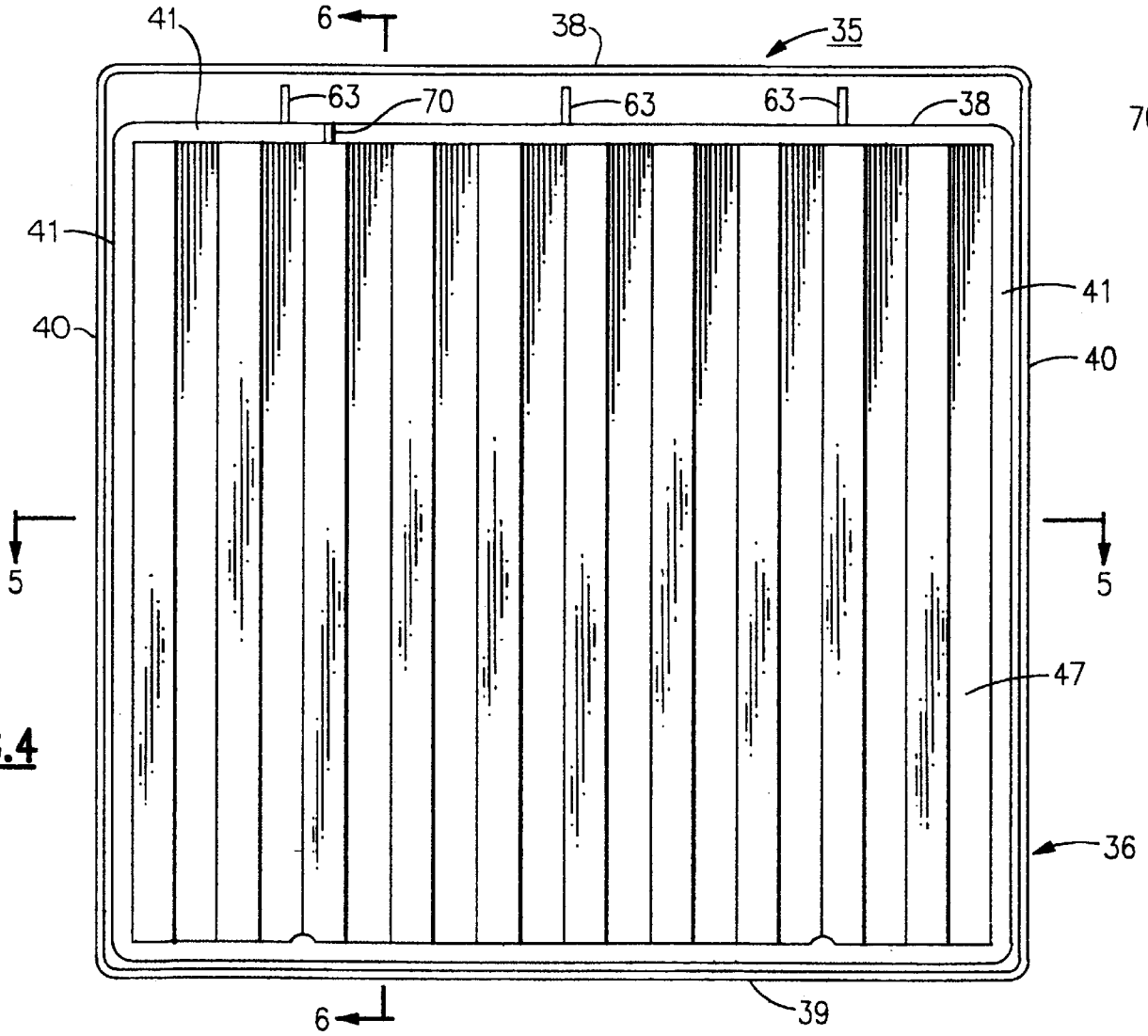
FIG. 4 is a front elevation of the present filter assembly.
Figure 5:
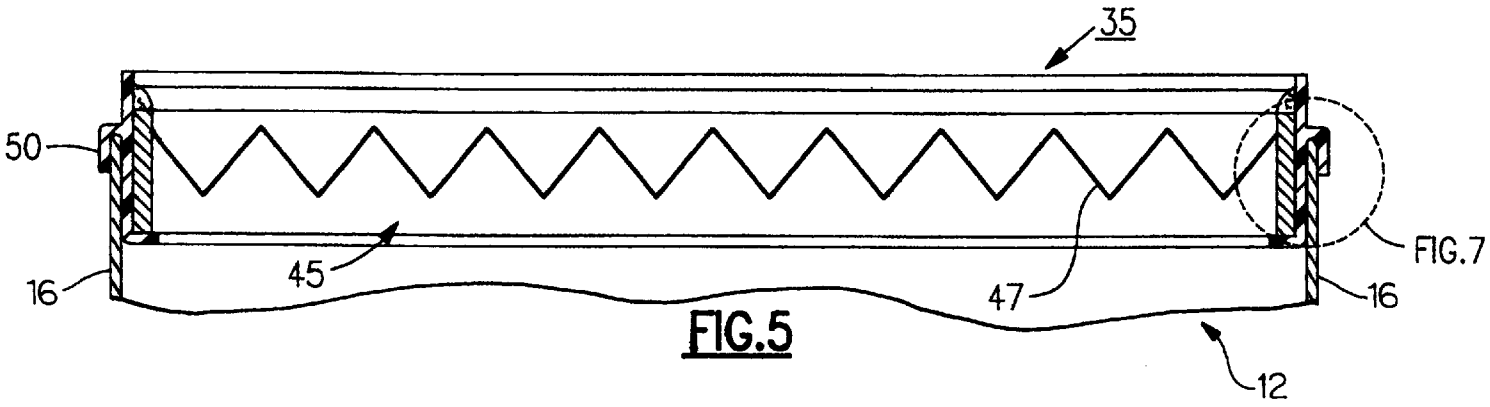
FIG. 5 is a section taken along lines 5—5 in FIG. 4.
Figure 7:
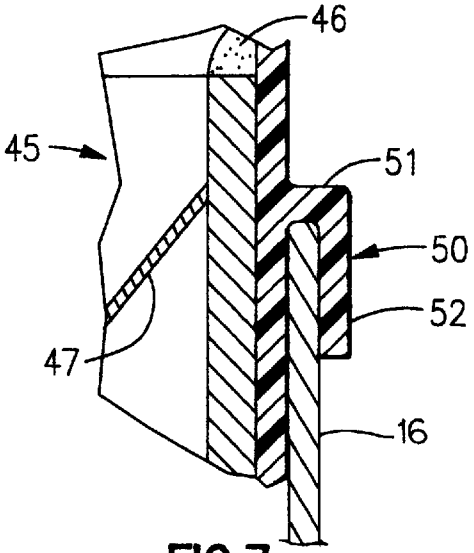
FIG. 7 is an enlarged partial view, in section, showing a portion of the flange that surrounds the filter frame.
Figure 8:
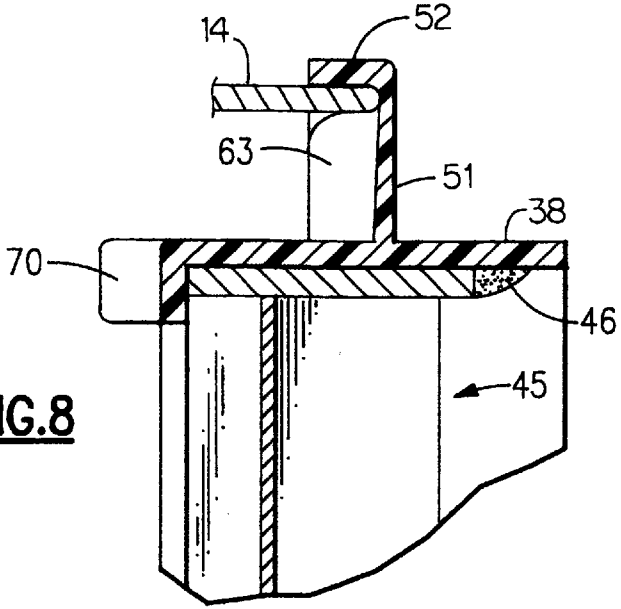
FIG. 8 is an enlarged partial view, in section, showing the upper part of the flange.

Turning now to FIGS. 1–3, there is shown an air purification unit, generally referenced 10, that embodies the teachings of the present invention. The unit includes a housing 11 containing a main support member 12 for supporting the component parts of the air purifying equipment and the housing covers that enclose the equipment. The support member is a rectangular shaped element containing a top wall 14, a bottom wall 15 and opposed side walls 16. An inner wall 17 is integrally joined to the other walls and has a central orifice 19 formed therein. A blower motor 20 is mounted upon a bracket on the front face of the inner wall. A scroll 23 is formed in the back face of the inner wall around the orifice and the motor shaft 24 is arranged to pass through the orifice into the scroll. A fan 25 is secured to the motor shaft and is fully contained inside the scroll. The front edge section of the main support frame serves as the air inlet to the blower. A rear cover 27 is affixed to the back of the support frame that contains a back panel 28 that encloses both the back of the scroll and a scroll discharge opening 29 formed in the top wall of the main support member to create an airtight passage therethrough.

A top cover 30 is secured to the top wall of the support member which contains an air discharge vent 31. A front cover 32 is removably fitted over the front of the support member and coacts with the other covers to close the housing. The front panel 33 of the front cover contains an air inlet vent 34 which permits ambient air to be drawn by the fan into the housing.

A filter assembly, generally referenced 35, is removably contained within the air inlet section of the support member and a includes rectangular filter frame 36 that is slidably received in the rectangular shaped air inlet to the blower.

With further reference to FIGS. 4–8, the filter assembly includes a molded frame 36 having a top wall 38, a bottom wall 39 and a pair of opposed side walls 40. An inwardly extended lip 41 depends from the front edge of each wall to provide additional strength and rigidity to the filter frame. A filter pack 45 is mounted inside the filter frame and is sealed to the interior surfaces of the frame walls by means of a hot-melt glue 46 (FIG. 8) to provide an airtight joint between the filter frame and the filter pack. A HEPA filter 47 is contained in the pack for removing fine particulates and other contaminants from the air stream drawn through the filter by the blower. As will be explained in greater detail below, the filter pack can be easily removed from the blower assembly to be cleaned or replaced depending on the nature of the filter material.

An L-shaped flange 50 (FIG. 7) surrounds the outside of the filter frame. The flange includes a continuous back wall 51 that is perpendicularly aligned with the walls of the frame and a continuous upper wall 52 that parallels the walls of the frame. The flange opens towards the front of the frame and is adapted to slidably receive therein the rectangular front edge of the air inlet to the blower at the front of the main support member. In assembly, the front edge of the air inlet closes against the back wall of the flange to form a seal for preventing the air that is being drawn through the filter from escaping from the filter assembly.

The upper wall 52 (FIG. 8) of the flange is offset a greater distance from the top wall 38 of the filter frame than from the other sections of the flange. Sufficient room is provided between the upper wall of the flange and the top wall of the filter frame to allow the flange in this region to be securely grasped to facilitate installation and removal of the assembly from the blower unit as well as carrying the assembly.

Ribs 63 are mounted on the top wall of the filter frame inside the flange. Sufficient space is provided between the top surfaces of the ribs and the inside surface of the flange upper surfaces to permit the top wall of the main support member to pass therebetween. The ribs help to locate and align the frame with respect to the blower air inlet during installation of the filter assembly. A generous radius 65 is formed at the top front edge of each rib to help guide the front edge of the blower air inlet under the flange. A close sliding fit is provided between the top of the flange and the remaining walls of the main support frame so that the filter frame fits snugly over the air inlet of the blower.

Figure 9:
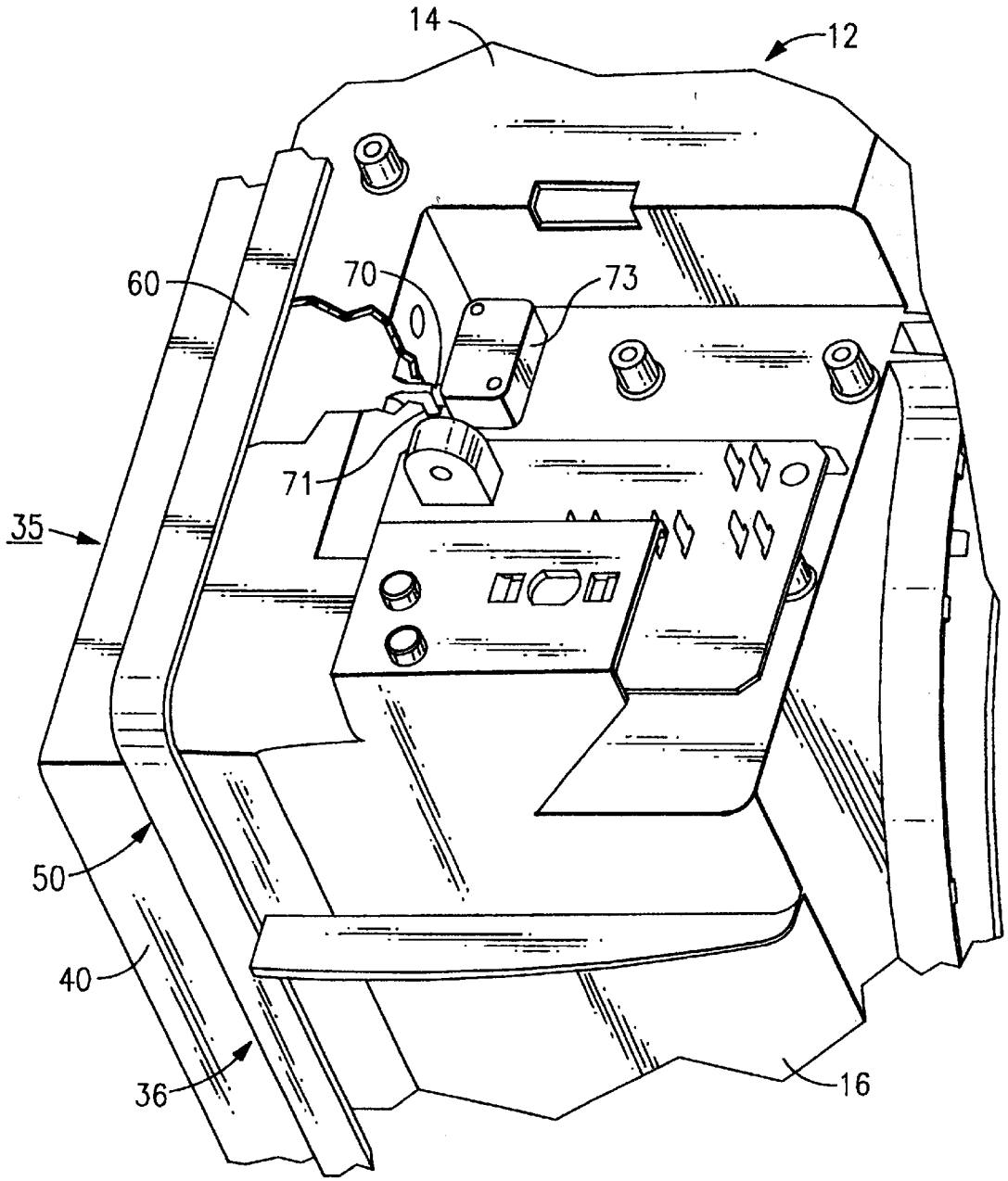
FIG. 9 is an enlarged view showing a tab mounted on the filter frame in position to actuate the blower motor switch.

Turning now to FIG. 9, a tab 70 is mounted upon the front lip associated with the top wall of the filter frame. At assembly, the tab that is arranged to pass through an opening 71 in the support member into contact with a safety switch 73 contained behind the opening to close the switch and thus provide power to the blower motor. Removal of the filter frame from the unit opens the switch thus disconnecting the motor from its power supply.

Preferably, the parts of the filter frame which include the walls, the flange, the front lip, the ribs and the tab are all integrally molded from a high strength plastic.

While this invention has been explained with reference to the structure disclosed herein, it is not confined to the details set forth and this invention is intended to cover any modifications and changes as may come within the scope of the following claims:

What is claimed is:

1. A filter assembly for use in an air purification unit having a rectangular air inlet to a unit blower, said filter assembly including a rectangular shaped frame having a bottom wall, a top wall and two opposed side walls, said filter frame having an open front end and an open back end, a filter pack containing a filter mounted inside the frame adjacent to the walls of the frame, an L-shaped flange extending from and surrounding the entire periphery of the walls of the frame, said flange having a continuous back wall that is perpendicular with and joined to the walls of the frame and a continuous upper wall that parallels the walls of the filter frame, said flange opening towards the front end of said frame for receiving therein a front edge section of a rectangular shaped air inlet to a blower whereby the air inlet closes against the back wall of the flange to form a seal and said upper wall of the flange and said adjacent top wall of the frame are spaced apart a greater distance than the spacing between the upper wall of the flange and the remaining walls of the frame whereby the upper wall of the flange adjacent the top wall of the flange forms an easily grasped handle.

2. The filter assembly of claim 1 that further includes a plurality of ribs mounted on said top wall of the frame inside the flange being arranged to ride in sliding contact with one edge of said air inlet to align and position the frame with the inlet during installation.

3. The filter assembly of claim 1 wherein the frame further includes an inwardly disposed rectangular shaped lip depending from the walls of the frame along the front of the frame for providing additional strength to the frame.

4. The filter assembly of claim 3 that further includes an actuating tab that protrudes outwardly from the front lip of the frame for engaging a blower motor safety switch when the frame is securely mounted on the air inlet to the blower with the front edge of the inlet in contact against the back wall of the frame.

5. The filter assembly of claim 3 wherein the frame, the flange and the lip are all integrally molded of plastic.

6. The filter assembly of claim 1 that further includes sealing means for providing an airtight joint between the filter pack and the walls of the filter frame.

* * * * *